US006439629B1

(12) United States Patent
Bieth

(10) Patent No.: US 6,439,629 B1
(45) Date of Patent: Aug. 27, 2002

(54) POST HOLE DIGGER

(76) Inventor: Albert F. Bieth, 640 N. Oro Ave., Stockton, CA (US) 95215

( * ) Notice: Subject to any disclaimer, the term of this patent is extended or adjusted under 35 U.S.C. 154(b) by 0 days.

(21) Appl. No.: 09/853,483

(22) Filed: May 11, 2001

(51) Int. Cl.[7] ..... A01B 1/18
(52) U.S. Cl. ..... 294/50.9
(58) Field of Search ..... 294/50.5–50.9, 294/53.5, 57, 104; 111/92, 101, 106

(56) References Cited

U.S. PATENT DOCUMENTS

| | | | | | |
|---|---|---|---|---|---|
| 139,169 | A | * | 5/1873 | Lindsley | 294/50.8 |
| 327,557 | A | * | 10/1885 | Kohler | 294/50.8 |
| 456,655 | A | * | 7/1891 | Kohler | 294/50.8 |
| 626,959 | A | * | 6/1899 | Avery et al. | 294/50.8 |
| 815,133 | A | * | 3/1906 | Van de Walker et al. | 294/50.9 |
| 819,791 | A | * | 5/1906 | Neste | 294/50.9 |
| 843,765 | A | * | 2/1907 | Nicholson | 294/50.8 |
| 856,066 | A | * | 6/1907 | Jenney | 294/50.9 |
| 1,855,477 | A | * | 4/1932 | Emery | 294/50.9 X |
| 1,860,963 | A | * | 5/1932 | Smith | 294/50.9 X |
| 1,908,322 | A | * | 5/1933 | Cook | 294/50.9 |
| 2,654,626 | A | | 10/1953 | Rice | |
| 4,042,270 | A | | 8/1977 | Weiland | |
| D311,853 | S | | 11/1990 | Stormsgaard | |
| 5,320,363 | A | | 6/1994 | Burnham | |
| 5,427,424 | A | * | 6/1995 | Robinson | 294/50.9 |
| 5,497,714 | A | * | 3/1996 | Schlotthauer | 294/50.8 X |
| 5,669,648 | A | | 9/1997 | Luck | |
| 5,743,579 | A | | 4/1998 | Ranburger | |

* cited by examiner

*Primary Examiner*—Johnny D. Cherry

(57) ABSTRACT

A post hole digger for allowing a user to dig a posthole with minimized physical effort. The post hole digger includes a digging assembly that has a pair of spade portions. The spade portions are adapted for being forced into dirt and closing together to collect some of the dirt for removal by the user. A handle is coupled to the digging assembly such that the handle is adapted to be held by the user for forcing the digging assembly in the dirt. An actuating member is coupled to the digging assembly. The actuating member is for actuating the digging assembly such that the actuating member is for closing and opening of the spade portions for collecting and releasing dirt when the digging assembly is being used to dig a post hole.

1 Claim, 2 Drawing Sheets

POST HOLE DIGGER

BACKGROUND OF THE INVENTION

1. Field of the Invention

The present invention relates to post hole diggers and more particularly pertains to a new post hole digger for allowing a user to dig a posthole with minimized physical effort.

2. Description of the Prior Art

The use of posthole diggers is known in the prior art. More specifically, posthole diggers heretofore devised and utilized are known to consist basically of familiar, expected and obvious structural configurations, notwithstanding the myriad of designs encompassed by the crowded prior art, which have been developed for the fulfillment of countless objectives and requirements.

Known prior art includes U.S. Pat. No. 5,669,648; U.S. Pat. No. 5,320,363; U.S. Pat. No. 5,743,579; U.S. Pat,. No. 4,042,270; U.S. Pat. No. Des. 311,853; and U.S. Pat. No. 2,654,626.

While these devices fulfill their respective, particular objectives and requirements, the aforementioned patents do not disclose a new post hole digger. The inventive device includes a digging assembly that has a pair of spade portions. The spade portions are adapted for being forced into dirt and closing together to collect some of the dirt for removal by the user. A handle is coupled to the digging assembly such that the handle is adapted to be held by the user for forcing the digging assembly in the dirt. An actuating member is coupled to the digging assembly. The actuating member is for actuating the digging assembly such that the actuating member is for closing and opening of the spade portions for collecting and releasing dirt when the digging assembly is being used to dig a post hole.

In these respects, the post hole digger according to the present invention substantially departs from the conventional concepts and designs of the prior art, and in so doing provides an apparatus primarily developed for the purpose of allowing a user to dig a posthole with minimized physical effort.

SUMMARY OF THE INVENTION

In view of the foregoing disadvantages inherent in the known types of post hole diggers now present in the prior art, the present invention provides a new post hole digger construction wherein the same can be utilized for allowing a user to dig a post hole with minimized physical effort.

The general purpose of the present invention, which will be described subsequently in greater detail, is to provide a new post hole digger apparatus and method which has many of the advantages of the post hole diggers mentioned heretofore and many novel features that result in a new post hole digger which is not anticipated, rendered obvious, suggested, or even implied by any of the prior art post hole diggers, either alone or in any combination thereof.

To attain this, the present invention generally comprises a digging assembly that has a pair of spade portions. The spade portions are adapted for being forced into dirt and closing together to collect some of the dirt for removal by the user. A handle is coupled to the digging assembly such that the handle is adapted to be by the user for forcing the digging assembly in the dirt. An actuating member is coupled to the digging assembly. The actuating member is for actuating the digging assembly such that the actuating member is for closing and opening of the spade portions for collecting and releasing dirt when the digging assembly is being used to dig a post hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new post hole digger apparatus and method which has many of the advantages of the post hole diggers mentioned heretofore and many novel features that result in a new post hole digger which is not anticipated, rendered obvious, suggested, or even implied by any of the prior art post hole diggers, either alone or in any combination thereof.

It is another object of the present invention to provide a new post hole digger, which may be easily and efficiently manufactured and marketed.

It is a further object of the present invention to provide a new post hole digger, which is of a durable and reliable construction.

An even further object of the present invention is to provide a new post hole digger which is susceptible of a low cost of manufacture with regard to both materials and labor, and which accordingly is then susceptible of low prices of sale to the consuming public, thereby making such post hole digger economically available to the buying public.

Still yet another object of the present invention is to provide a new post hole digger, which provides in the apparatuses and methods of the prior art some of the advantages thereof, while simultaneously overcoming some of the disadvantages normally associated therewith.

Still another object of the present invention is to provide a new post hole digger for allowing a user to dig a posthole with minimized physical effort.

Yet another object of the present invention is to provide a new post hole digger, which includes a digging assembly that has a pair of spade portions. The spade portions are adapted for being forced into dirt and closing together to collect some of the dirt for removal by the user. A handle is coupled to the digging assembly such that the handle is adapted to be held by the user for forcing the digging assembly in the dirt. An actuating member is coupled to the digging assembly. The actuating member is for actuating the digging assembly such that the actuating member is for closing and opening of the spade portions for collecting and releasing dirt when the digging assembly is being used to dig a post hole.

Still yet another object of the present invention is to provide a new post hole digger that would be its ease of use, convenience, reduction of labor and physical strain, and cost-effectiveness.

Even still another object of the present invention is to provide a new post hole digger that the design of the present invention would prevent a handle from breaking, which would prevent the user from having to purchase a new posthole digger.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
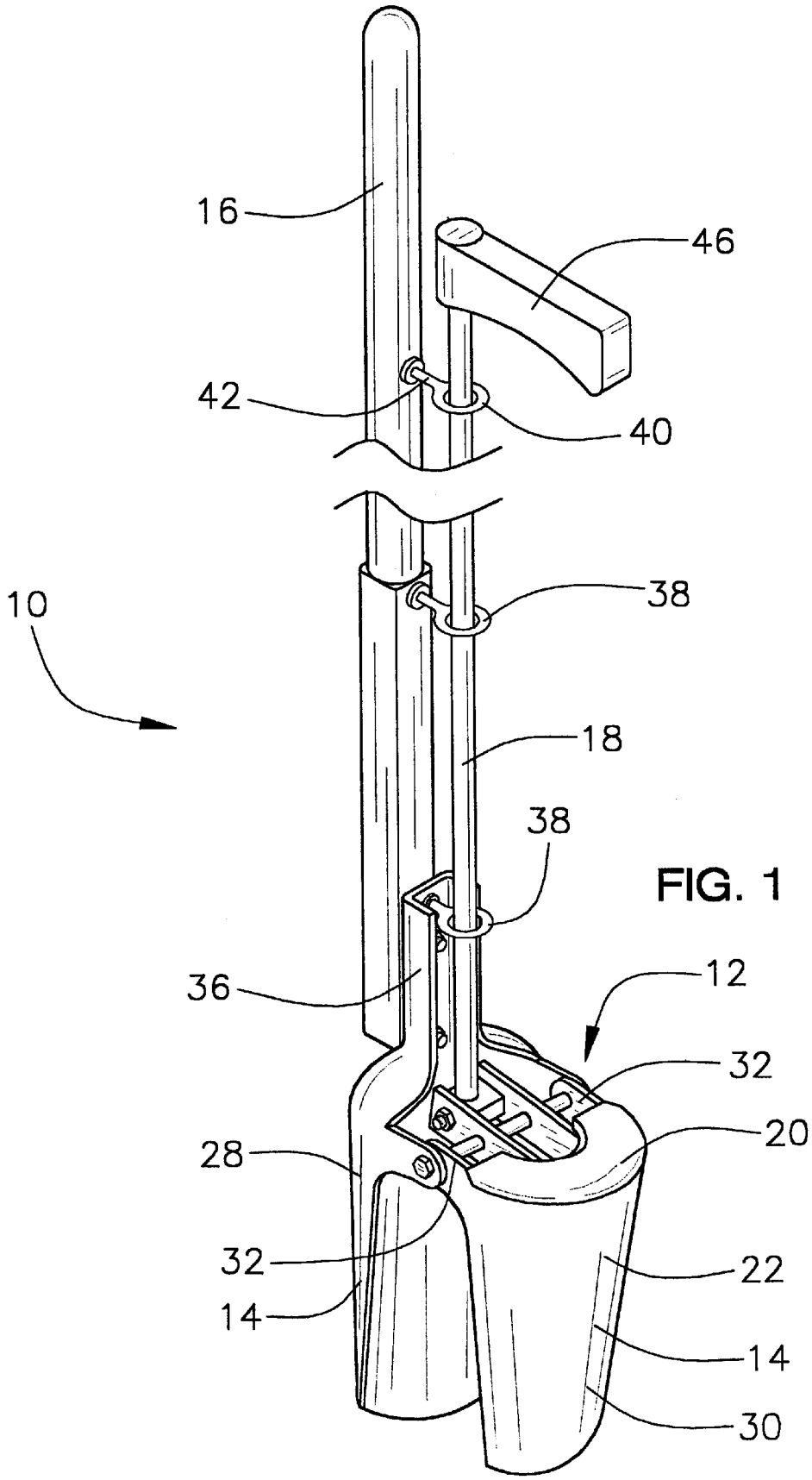
FIG. 1 is a perspective view of a new post hole digger according to the present invention.
Figure 2:
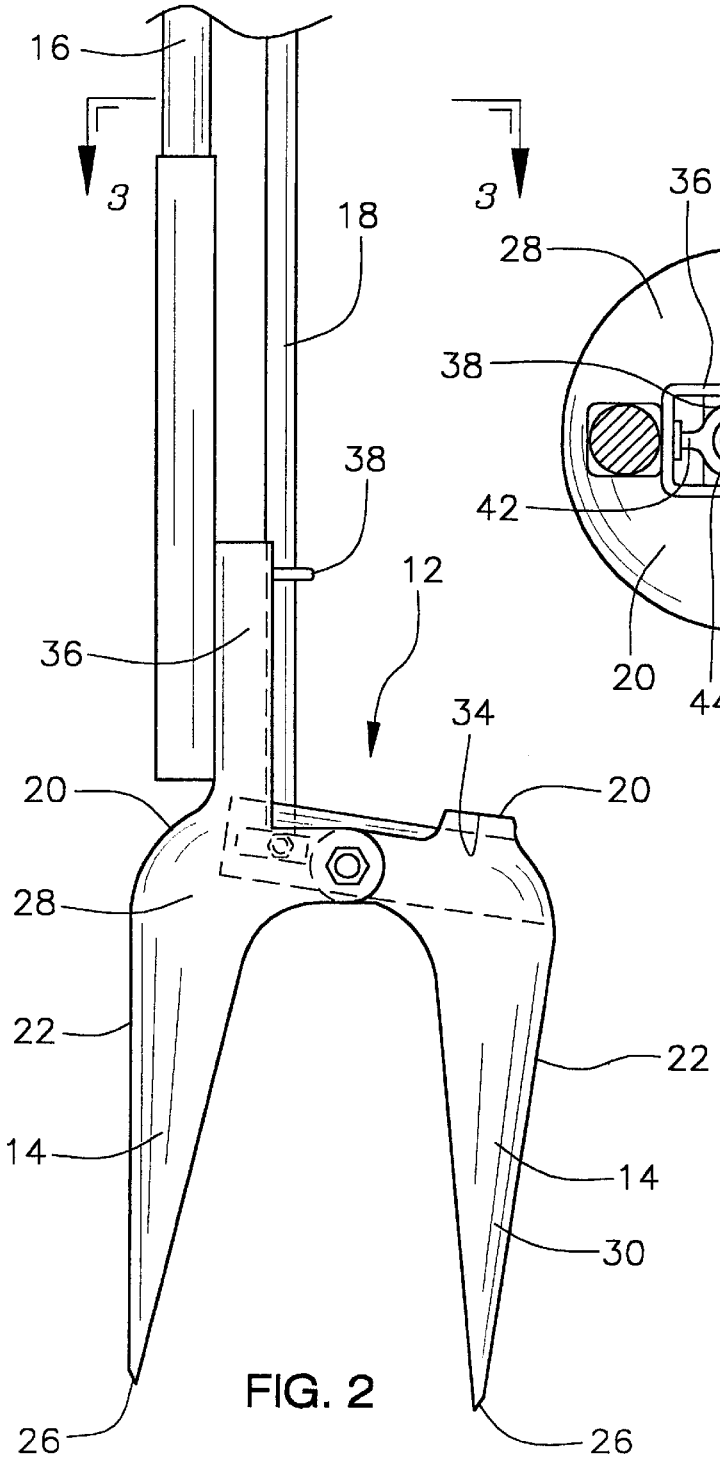
FIG. 2 is a side view of the present invention.
Figure 3:
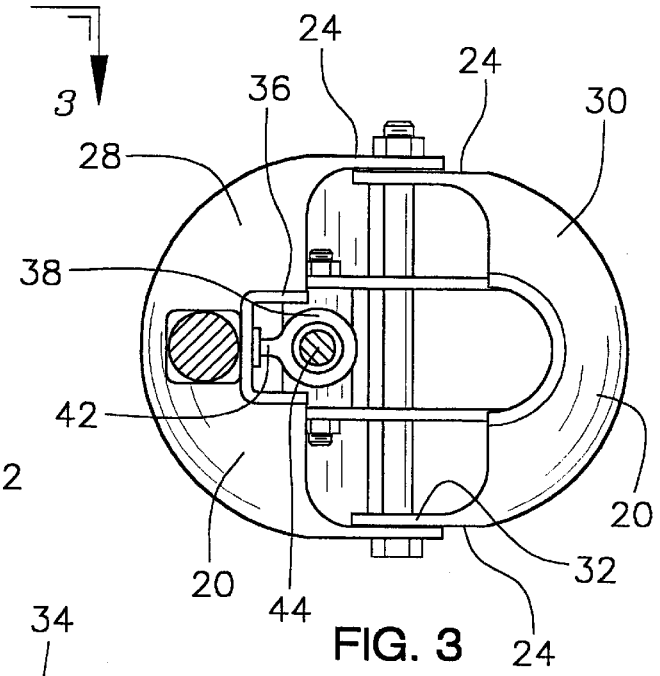
FIG. 3 is a top view of the present invention.

With reference now to the drawings, and in particular to FIGS. 1 through 3 thereof, a new post hole digger embodying the principles and concepts of the present invention and generally designated by the reference numeral 10 will be described.

As best illustrated in FIGS. 1 through 3, the post hole digger 10 generally includes a digging assembly 12 that has a pair of spade portions 14. The spade portions 14 are adapted for being forced into dirt and closing together to collect some of the dirt for removal by the user. A handle 16 is coupled to the digging assembly 12 such that the handle 16 is adapted for being held by the user for forcing the digging assembly 12 in the dirt. An actuating member 18 is coupled to the digging assembly 12. The actuating member 18 is for actuating the digging assembly 12 such that the actuating member 18 is for closing and opening of the spade portions 14 for collecting and releasing dirt when the digging assembly 12 is being used to dig a post hole.

Each of the spade portions 14 of the digging assembly 12 includes a top wall 20 and a perimeter wall 22 that extend-from the top wall 20. The perimeter wall 22 of each of the spade portions 14 has an arcuate cross-section taken perpendicularly to a longitudinal axis of the perimeter wall 22. The perimeter wall 22 of each of the spade portions 14 has a pair of side portions 24. Each of the side portions 24 taper-towards a distal end 26 of the perimeter wall 22. The distal end 26 of the perimeter wall 22 is adapted for facilitating insertion of the spade portions 14 into the dirt.

The pair of spade portions 14 includes a first spade portion 28 and a second spade portion 30. The first spade portion 28 is fixedly coupled to the handle 16. The top wall 20 of the second spade portion 30 is pivotally coupled to the first spade portion 28. The second spade portion 30 is coupled to the actuating member 18 such that the second spade portion 30 and the first spade portion 28 are adapted for holding dirt when the second spade portion 30 is pivoted towards the second spade portion 30 through actuation of the actuating member 18.

The second spade portion 30 has a pair of arms 32 coupled to an interior surface 34 of the top wall 20 of the second spade portion 30. The arms 32 extend from the top wall 20 towards the first spade portion 28. The arms 32 are pivotally coupled to the actuating member 18 such that the movement of the actuating member 18 pivots the second spade portion 30 with respect to the first spade portion 28.

The first spade portion 28 has a stanchion 36. The stanchion 36 upwardly extends from the top wall 20 of the first spade portion 28. The stanchion 36 is coupled to the handle 16 such that the stanchion 36 is for providing support to the digging assembly 12 when the spade portions 14 are driven into the dirt.

A plurality of guide members 38 are coupled to the handle 16. Each of the guide members 38 is adapted for slidably receiving a portion of the actuating member 18 such that the guide members 38 are for maintaining alignment between the actuating member 18 and the handle 16. Each of the guide members 38 has an annular ring 40 and a shaft 42. The shaft 42 is for coupling to the handle 16. The annular ring 40 is coupled to the shaft 42 such that an aperture 44 formed by the annular ring 40 is for slidably receiving the actuating member 18 through the aperture 44.

A hand member 46 is coupled to an upper end of the actuating member 18. The hand member 46 is adapted to be gripped by a hand of the user. The hand member 46 extends outwardly from the actuating member 18 away from the handle 16 such that the hand member 46 is for facilitating actuation of the digging assembly 12 when the hand member 46 is pulled by the hand of the user.

In an embodiment the present invention measures 60 inches in length.

In use, a user grips the handle that is coupled to the digging assembly such that the handle is adapted for forcing the digging assembly in the dirt. The spade portion closes together to collect some of the dirt for removal by the user. The actuating member is for actuating the digging assembly such that the actuating member is for closing and opening of the spade portions for collecting and releasing dirt when the digging assembly is being used to dig a post hole.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A post hole digger for digging a post hole by a user, the post hole digger comprising:

a digging assembly having a pair of spade portions, one of said spade portions being pivotally coupled to the other of said spade portions such that said spade portions are closable together to collect dirt therebetween for removal by the user when the user inserts said spade portions into the dirt;

a handle being coupled to said digging assembly;

an actuating member being coupled to said digging assembly, said actuating member being for actuating said digging assembly such that said actuating member closes and opens said spade portions for collecting and releasing dirt when said digging assembly is being used to dig a post hole;

wherein each of said spade portions of said digging assembly comprises a top wall and perimeter wall extending from said top wall, said perimeter wall of each of said spade portions having an arcuate cross-section taken perpendicularly to a longitudinal axis of said perimeter wall;

wherein said perimeter wall of each of said spade portions has a pair of side portions, each of said side portions tapering towards a distal end of said perimeter wall for facilitating insertion into the dirt;

wherein said pair of spade portions includes a first spade portion and a second spade portion, said first spade portion being fixedly coupled to said handle, said top wall of said second spade portion being pivotally coupled to said first spade portion, said second spade portion being coupled to said actuating member for holding dirt between said second spade portion and said first spade portion when said second spade portion is pivoted towards said first spade portion through actuation of said actuating member;

wherein said second spade portion has a pair of arms being coupled to an interior surface of said top wall of said second spade portion, said arms extending from said top wall towards said first spade portion, said arms being pivotally coupled to said actuating member such that movement of said actuating member pivots said second spade portion with respect to said first spade portion;

wherein said first spade portion has a stanchion, said stanchion upwardly extending from said top wall of said first spade portion, said stanchion being coupled to said handle such that said stanchion provides support to said digging assembly when said spade portions are driven into the dirt;

wherein a plurality of guide members are coupled to said handle, each of said guide member slidably receiving a portion of said actuating member such that said guide members maintain alignment between said actuating member and said handle;

wherein each of said guide members has an annular ring and a shaft, said shaft being coupled to said handle, said annular ring being coupled to said shaft such that an aperture formed by said annular ring slidably receives said actuating member through said aperture; and wherein a hand member is coupled to an upper end of said actuating member, said hand member extending outwardly from said actuating member away from said handle such that said hand member is positioned over said second spade portion, said hand member actuating said digging assembly when said hand member is pulled by the hand of the user.

* * * * *